US006457513B1

(12) United States Patent
Walker

(10) Patent No.: US 6,457,513 B1
(45) Date of Patent: Oct. 1, 2002

(54) SEGMENTED FLOW DEVICE

(75) Inventor: Paul N. Walker, Bellefonte, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 09/601,661

(22) PCT Filed: Feb. 4, 1999

(86) PCT No.: PCT/US99/02730

§ 371 (c)(1),
(2), (4) Date: Aug. 3, 2000

(87) PCT Pub. No.: WO99/40384

PCT Pub. Date: Aug. 12, 1999

Related U.S. Application Data

(60) Provisional application No. 60/073,773, filed on Feb. 5, 1998, and provisional application No. 60/101,378, filed on Sep. 22, 1998.

(51) Int. Cl.[7] ..... A23C 3/02; F28D 11/00; A23L 3/00; A23B 3/12

(52) U.S. Cl. ..... 165/66; 165/120; 165/86; 99/470; 99/443 C

(58) Field of Search ..... 165/120, 88, 87, 165/86, 11.1, 66; 99/470, 495, 483, 443 C, 468

(56) References Cited

U.S. PATENT DOCUMENTS 1,868,091 A * 7/1932 Brooke ..... 165/120
2,512,045 A * 6/1950 Steinberg et al. ..... 165/66
3,086,868 A 4/1963 Keifer
3,910,175 A * 10/1975 Smith ..... 99/443 C
3,927,715 A * 12/1975 Castanoli ..... 165/120
4,073,226 A * 2/1978 Shulz ..... 99/443 C
4,637,936 A 1/1987 White et al.
4,796,523 A 1/1989 Mette
4,802,825 A 2/1989 Hermans
4,850,270 A * 7/1989 Bronnert ..... 99/355
4,953,633 A 9/1990 Hermans
5,080,164 A 1/1992 Hermans
5,824,266 A * 10/1998 Badertscher et al. ..... 99/468
5,829,224 A 11/1998 Sizer
5,968,578 A * 10/1999 Knisely ..... 165/120

* cited by examiner

*Primary Examiner*—Henry Bennett
*Assistant Examiner*—Tho V Duong
(74) *Attorney, Agent, or Firm*—Webb Ziesenheim Logsdon Orkin & Hanson, P.C.

(57) ABSTRACT

The present invention is a segmented flow device for performing the functions of a reactor, heat exchanger or holding tube or their combination. The device controls the residence time of all of liquid and solid particles which make up a flow in the device. By controlling the residence time, the prediction of residence time becomes less of an issue during processing. The segmented flow device reduces the difference in residence time between the fastest and slowest moving particles of the flow. The device allows all of the particles to receive nearly the same processing time to reduce under-processing or over-processing of the particles If desired, the device allows the residence time of the larger solid particles to be controlled to be longer or shorter than the average of the residence time of other particles of the flow, such as the liquid and smaller solid particles.

25 Claims, 6 Drawing Sheets

SEGMENTED FLOW DEVICE

This application claims the benefit of U.S. Provisional Application No.: 60/073,773 filed Feb. 5, 1998 and U.S. Provisional Application No.: 60/101,378 filed Sep. 22, 1998.

BACKGROUND

Prediction and control of residence time of an object or particle in a reactor, heat exchanger or holding tube is important for many continuous flow processing operations. One example of a continuous flow processing operation is aseptic processing of liquid based foods, such as potato soup. Usually, liquid based foods include liquid particles, large solid particles and smaller solid particles. The prediction and control a particle's residence time assures the correct processing time for the particle. The residence time of large solid particles is especially important during the aseptic processing of foods with large solid particles. Continuous flow operations usually involve a flow confined by at least one wall. Hence, the flow of particles may be slower near the wall than away from the wall. In fact in a tube with laminar flow, the outside portion of the flow is usually much slower than the center portion of the flow. This creates a situation where individual particles of the flow can be under-processed or over-processed, due to the different residence times.

Conventional continuous flow reactors, heat exchangers, and holding tubes have relatively wide distributions of residence times for individual particles of the flow. The individual particles can have much longer or shorter processing time than the average processing time of all the particles. A wide distribution of residence times means some particles are processed for much shorter times, while other particles are processed for much longer times. To compensate, often the processing time is increased to insure that the fastest moving particles receive the minimum allowable processing. Whereby, the tradeoff is that the slowest moving particles are over-processed. Depending on the application, this can translate to inferior quality product, increased energy usage and reduced throughput.

Several approaches have been used to resolve the problems associated with the wide distribution of residence times in continuous processing. A first approach is the use of empirical data or mathematical models to determine the distribution of residence times for a particular set of flow conditions of individual particles. Once the distribution is determined, the processing time can be adjusted appropriately. The problem is that accurately modeling the residence time is a complex process because of the interaction of numerous factors. Likewise, the collection of empirical data is difficult because seemingly insignificant, uncontrolled differences in flow conditions can result in important changes of residence time distribution. A second approach is to control flow parameters such as laminar or turbulent flow, tube diameter, tube length, or flow path to create the desired distribution of residence times. The control of flow parameters to achieve the desired distribution of residence times is problematic for the same reasons as the first approach. Furthermore, even if residence time can be accurately predicted or measured, the fact remains that the distribution is often wider than desired and flow parameter control is often inadequate to achieve a narrow distribution of residence times. A third approach is to use batch processing rather than continuous processing. Batch processing can easily provide a narrow distribution of residence times and is often the best solution. The problems with batch processing is that it creates materials handling problems, scheduling problems and is more expensive. A final approach is the development of mechanisms that physically control residence time. Current applications of this approach are not without disadvantages. Some are difficult to implement, some damage particles of the flow, while others do not always provide a uniform control of residence time. Furthermore, they do not specifically control residence time of liquid particles apart from solid particles in the flow. This leads to the over-processing of some of the particles in the flow, thereby resulting in a reduction in product quality.

It is an object of the present invention to provide a system for the uniform processing of a flow of particles.

It is an object of the present invention to provide the control of residence time of individual particles in a continuous flow processing operation.

It is an object of the present invention to provide system to prevent the necessity of over-processing foods to meet safety requirements in a continuous flow processing operation.

SUMMARY OF THE INVENTION

The present invention provides a segmented flow device for controlling the residence time of particles in a flow. The device includes a processing conduit having an inlet end and an outlet end. A feed port is at the inlet end for inserting the flow to be processed. A release port is at the outlet end for removing the flow after processing. The device includes a series of barriers moving through the processing conduit to segment the flow during processing to allow control of residence time of the particles of the flow. A continuation section provides a path between the inlet and outlet ends of the processing conduit for receiving the barriers from the outlet end and returning the barriers to the inlet end. A first input in the device is for providing an inlet pressure to the inlet end and a second input for providing an outlet pressure to the outlet end, such that the inlet and outlet pressures are also used for controlling the flow.

DETAILED DESCRIPTION OF THE INVENTION

The present invention is a segmented flow device for performing the functions of a reactor, heat exchanger or holding tube or their combination. The device controls the residence time of all of liquid and solid particles which make up a flow in the device. The prediction and control of the residence time is especially important in the continuous aseptic processing of liquid based foods with large solid particles. By controlling the residence time, the prediction of residence time becomes less of an issue during processing. The segmented flow device reduces the difference in residence time between the fastest and slowest moving particles of the flow. The device allows all of the particles to receive nearly the same processing time. When the particles of a flow receive nearly the same processing time, the particles are less likely to be under-processed or over-processed. If desired, the device allows the residence time of the larger solid particles to be controlled to be longer or shorter than the average of the residence time of other particles of the flow, such as the liquid and smaller solid particles. Throughout, the segmented flow device will be discussed using the example of processing liquid based foods, such as potato soup. The segmented flow device allows the liquid based foods containing solid particles, such as potatoes, to be continuously and thermally processed. The device can be used to easily assure each food particle receives sufficient thermal treatment for microbial safety, while reducing the chance of over-processing.

Figure 1:
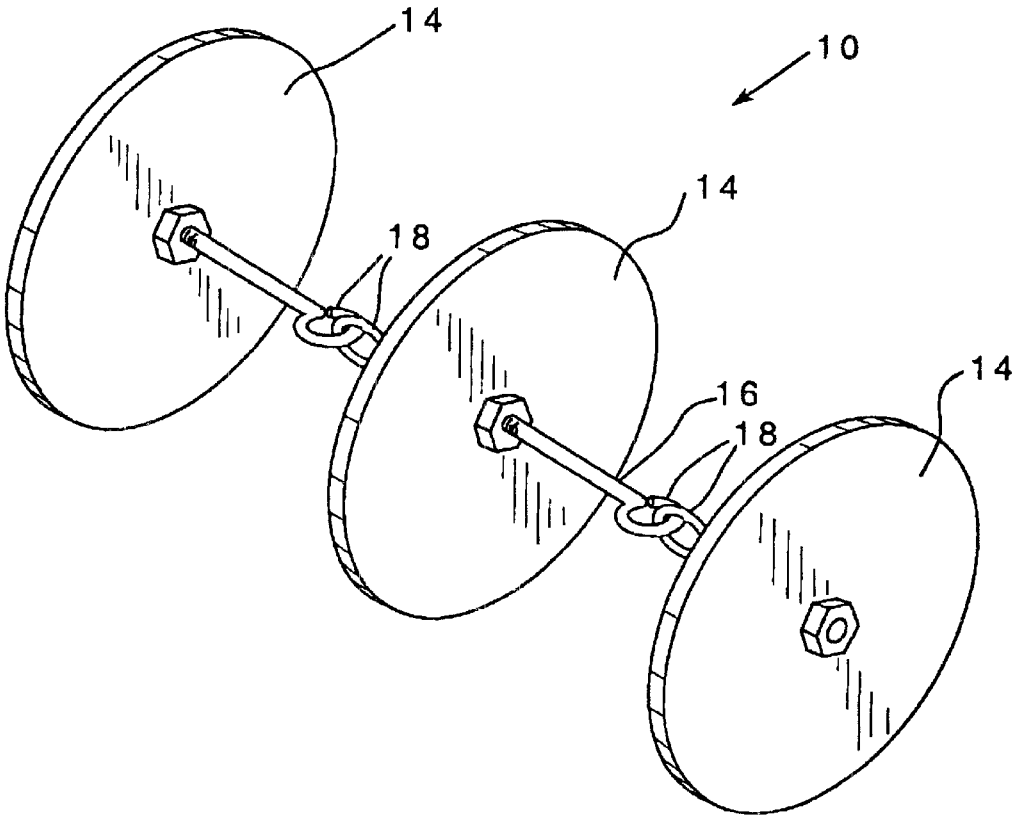
FIG. 1 is a perspective view of linked barriers according to the present invention.
Figure 2:
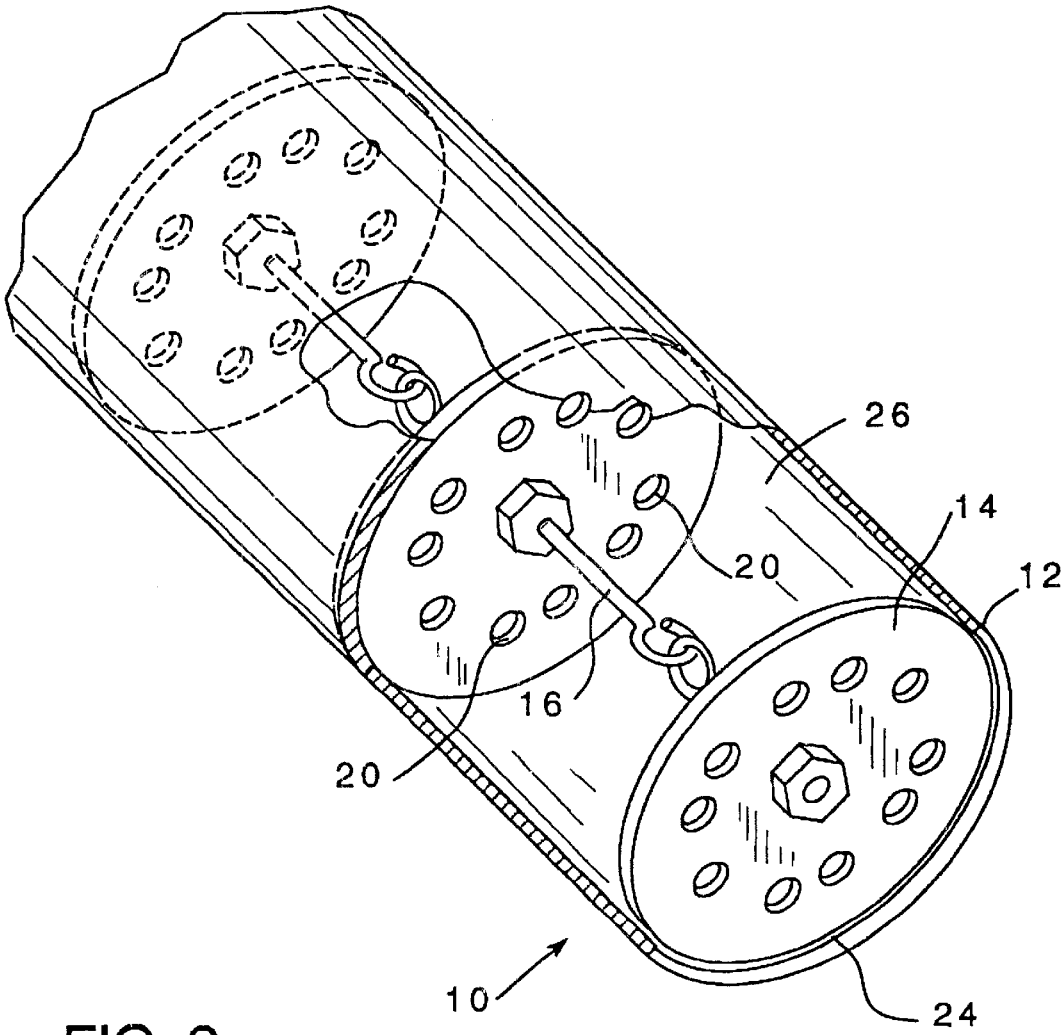
FIG. 2 is a perspective view of linked barriers with preforations in a cutaway view of a processing conduit according to the present invention.
Figure 3:
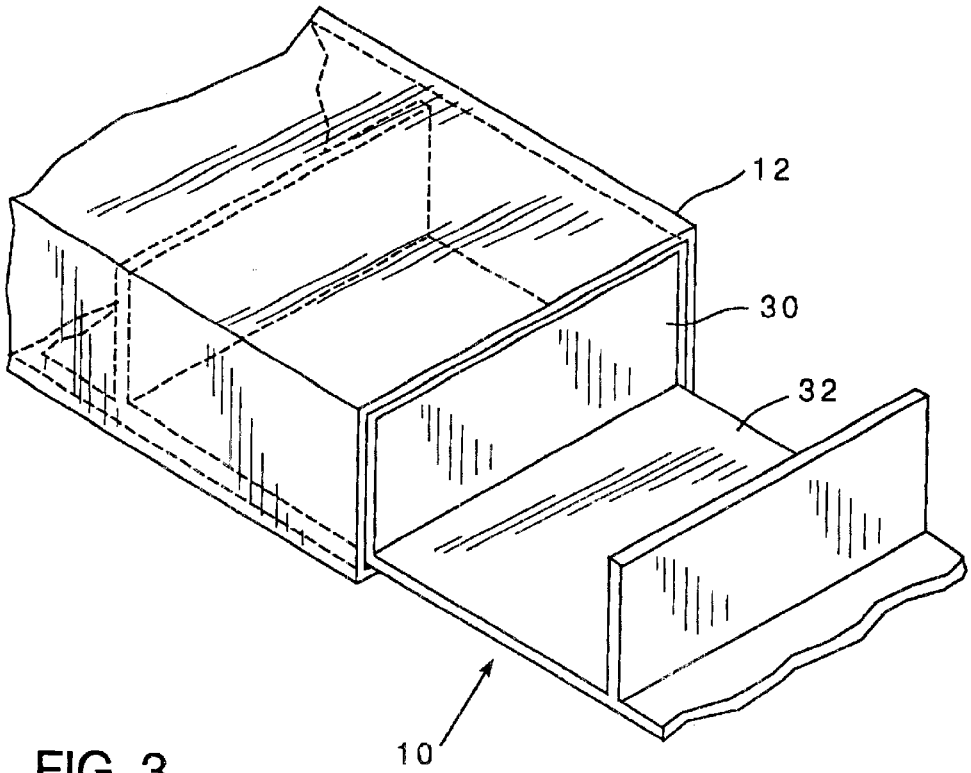
FIG. 3 is a perspective view of another type of linked barriers in a conduit according to the present invention.
Figure 4:
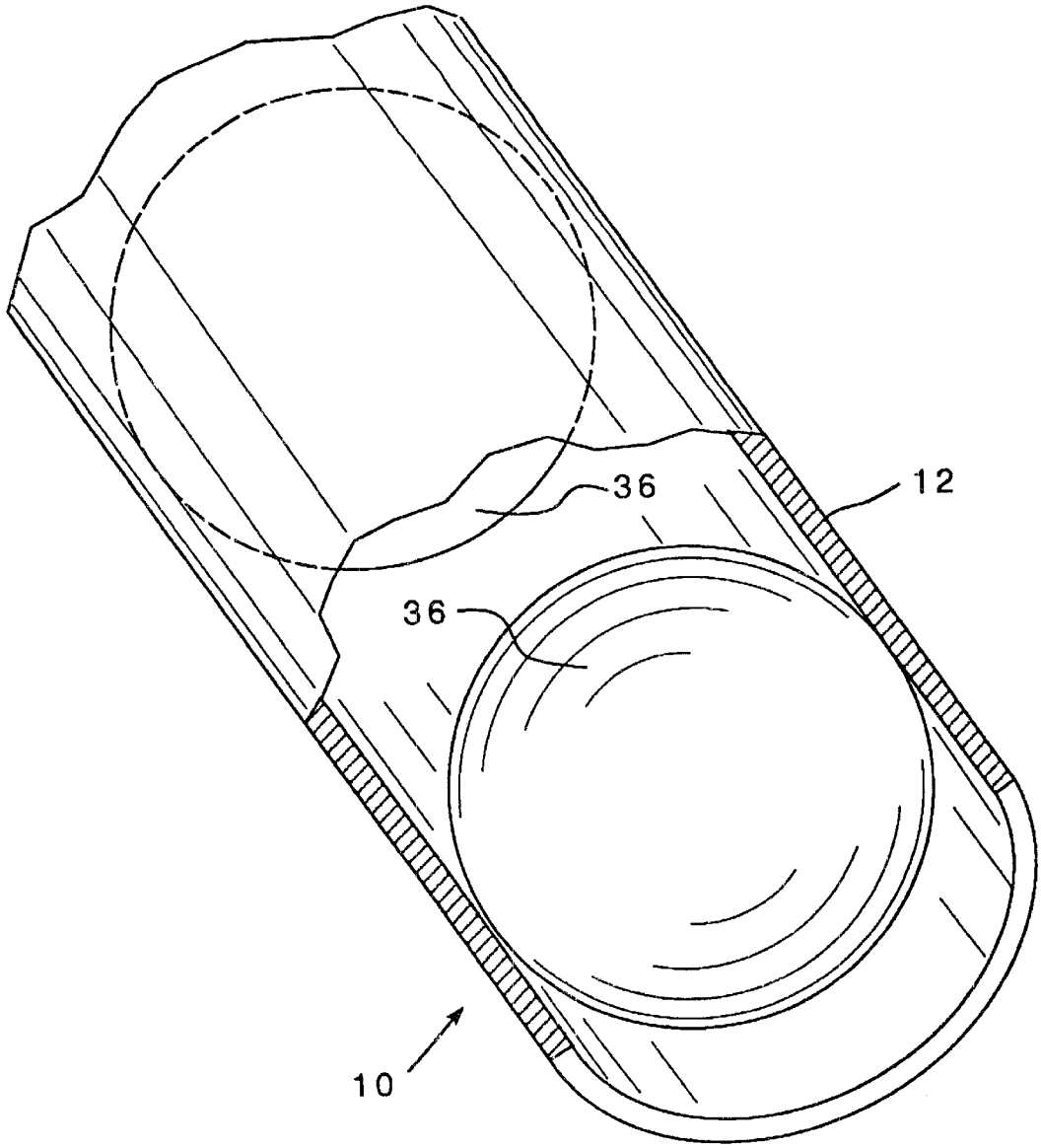
FIG. 4 is a perspective view of unlinked barriers in a cutaway view of a processing conduit according to the present invention.

The present invention uses a series of physical barriers 10. Examples of different barriers 10 are shown in FIGS. 1–4. The barriers 10 move through a processing conduit 12 one after the other. The examples shown include barriers 10 linked together and barriers 10 which are not-linked together. The barriers 10 can be of a soft flexible material or a stiff material. The conduit 12 can be straight or curved and circular or non-circular in cross section. FIG. 1 shows a series of barriers 10 that are solid round disks 14 linked together by rods 16. The rods 16 have looped ends 18 which engage each other. FIG. 2 shows a series of barriers 10 that are round disks 14 with perforations 20 and linked together by the rods 16. The disks 14 are shown in a round conduit 12, where there is a gap 24 between the inside wall 26 of the conduit 12 and the disks 14. FIG. 3 shows a series of barriers 10 that are rectangular cleats 30, which are attached to a conveyor belt 32. The rectangular cleats 30 are shown in a rectangular conduit 12. FIG. 4 shows a series of barriers 10 which are unlinked spheres 36. The spheres 36 are propelled by the force of the flow in the conduit 12. The unlinked barriers 10 can be almost any geometric shape. The gaps 24 and perforations 20 shown in FIGS. 1–4 can be applied in many combinations or configurations and are not limited as to specific manner of each of the examples shown.

In any of the above cases, the barriers 10 move with the flow in the conduit 12 and therefore divide the flow into smaller segments. The barriers 10 reduce or eliminate mixing of particles in one segment with the particles of another segment. Depending on the application, the physical barriers 10 can provide a seal with no gap 24 or perforations 20 to essentially prevent mixing of all liquid and solid particles between segments. Alternately, the barriers 10 can be of an unsealed variety by adjusting the gap 24 clearances between the barriers 10 and the inside wall 26 of the conduit 12 and/or having the perforations 20. The gap 24 and perforations 20 allow mixing of the liquid particles and the smaller solid particles, while preventing the mixing of larger solid particles between segments. When the liquid and smaller solid particles of the flow are allowed to move between segments, the average residence time of those particles can be controlled to be longer or shorter than for the particles trapped between the barriers 10. The control of the liquid and smaller solid particles will be explained further in this specification.

Using the example of the continuous aseptic processing of potato soup, it is important that the centers of large potato particles receive sufficient thermal treatment to kill microbes and spores. It is assumed that if the large potato particles receive sufficient thermal treatment for a certain residence time, that the small potato particles and liquid particles also received sufficient treatment for the same residence time. Therefore, it is important that the residence time of the large particles be known, so the process can be controlled to ensure the proper minimum thermal processing for microbial safety. The segmented flow device achieves the desired result by using the series of physical barriers 10. The barriers 10 move with the flow of liquid and potato particles for the potato soup, trapping some or all of the particles of the flow between those barriers 10. The trapped particles are prevented from moving from one segment to another. The residence time distribution of trapped particles is thereby controlled. If the distance between the barriers 10 is small compared to the total length of the process, all the trapped particles have essentially the same residence time. The residence time is the length of the process divided by the speed of the barriers 10 moving through the process. A desired residence time can be achieved, by controlling the length of the process and the spacing and speed of the barriers 10.

Also, the average residence time of non-trapped particles can be controlled to be longer or shorter than the residence time of the trapped particles. In aseptic processing of food or other applications it may be desirable only to confine the larger solid particles to a narrow residence time. In the case of potato soup, the liquid and smaller solid particles can be allowed to bypass the barriers 10 or to be passed by the barriers 10. As described above, the gap 24 between the barriers 10 and the conduit 12 and/or the perforations 20 in the barriers 10 allows the liquid and smaller solid particles to move independently of the barriers 10. By controlling liquid and smaller solid particle flow independently of barrier speed, the average residence time of these particles can be longer or shorter than that for the large solid particles. Independent control of the liquid and smaller solid particles can be achieved by having a differential pressure between the input and output of the process. If the pressure is lower at the output than the input, the speed of the liquid and smaller solid particles will be faster, whereby if the pressure is higher at the output than the input, the speed of that same particles will be slower. Adjustment of the differential pressure as described allows for the movement of the liquid and smaller solid particles to be faster or slower then the flow segmented by the barriers 10. This control of pressure and flow can also be used to help prevent leakage around the barriers 10.

Figure 5:
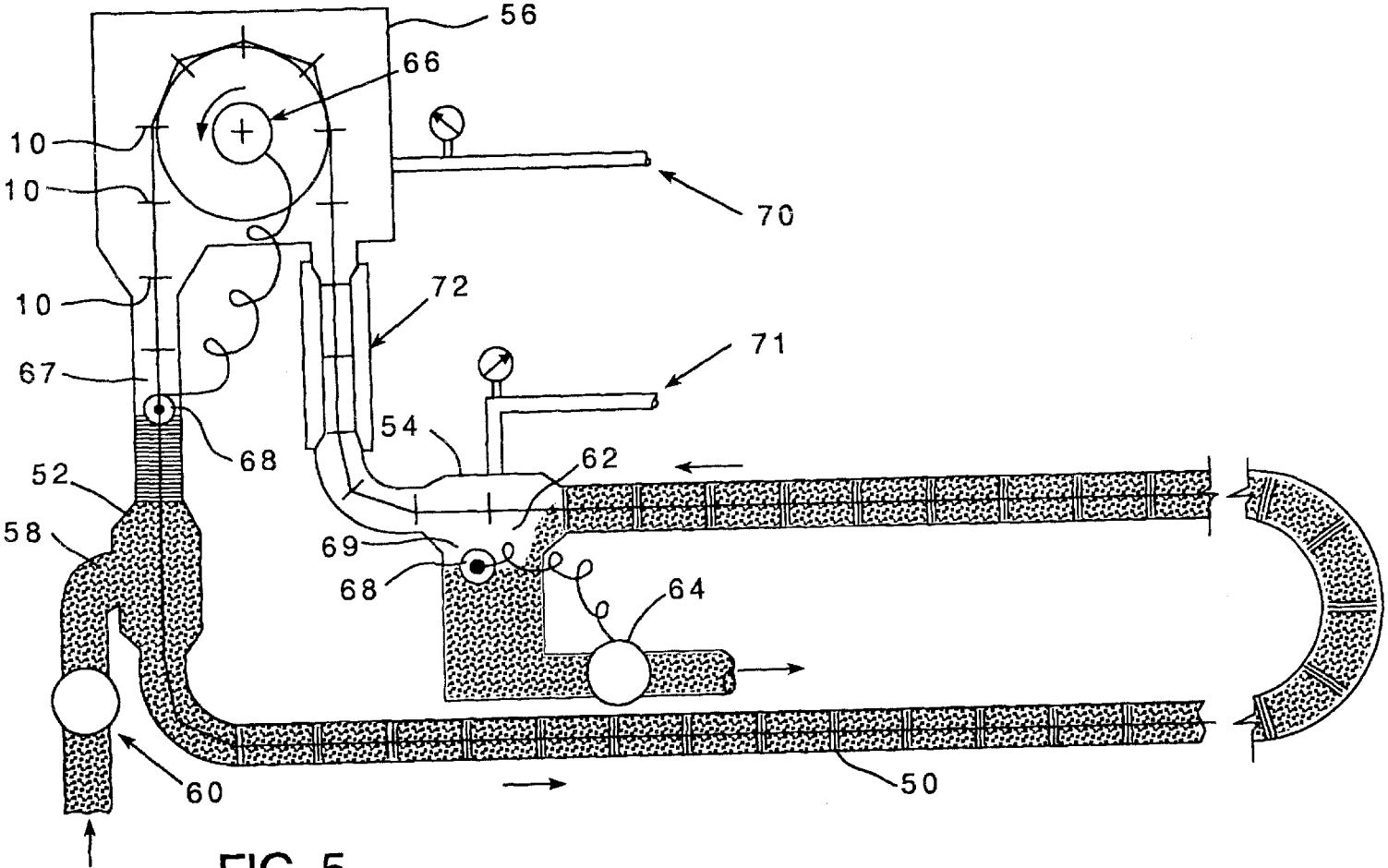
FIG. 5 is a cross-sectional view of a continuous flow processing system according to the present invention.

Aseptic food processing systems normally contain a heat exchanger to heat the food, a holding tube and a heat exchanger to cool the food. FIG. 5 shows one configuration of the present invention for functioning as an aseptic processing holding tube. This configuration could also be considered as a reactor. Included as part of the holding tube is a processing conduit 50 having an inlet end 52 and an outlet end 54. Between and connecting the inlet and outlet ends 52, 54 is a conduit continuation section 56. At the inlet end 52 is a feed port 58 to receive food, such as the potato soup for processing. A feed pump 60 is shown at the inlet end 52 to pump the food into the feed port 58 of the conduit 50. At the outlet end 54 is a release port 62 for removal of the processed food from the conduit 50. A back pressure pump 64 is shown at the outlet end 54 to control the release of food from the release port 62. A series of barriers 10 is shown which continuously runs through the conduit 50. In FIG. 5, the barriers 10 are shown linked together, but any of the barriers 10 described above, as well as other equivalents could be used. The continual running of the barriers 10 is achieved by the continuation section 56. In this case, the continuation section 56 includes a motorized drive unit 66 to propel the linked barriers 10. The drive unit 66, as envisioned, includes some type of sprocket which engages and propels the barriers 10, whereby the sprocket is driven by a motor. Sensors 68 monitor the level of the flow at points 67, 69 of the inlet end 52 and outlet end 54, respectively. The sensors 68 provide data to automated electronic controls (not shown) for controlling the backpressure pump 64, feed pump 60 and the drive unit 66. The backpressure pump 64, feed pump 60 and the drive unit 66 could also be controlled manually. Input pipes 70, 71 are used to supply a gas, if it is desired to pressurize the system. The pipe 70 provides pressure at the inlet end 52 and the pipe 71 provides pressure at the outlet end 54. An optional seal unit 72 allows the pressure to be different at the inlet and outlet ends 52, 54. Other controls such as temperature and pressure controls are used with the system, but are not shown.

Flow level is controlled as in the following manner. The speed of the feed pump 60 can be made effectively constant and the speed of the barriers 10 adjusted by the drive unit 66 based on the level of the flow at the inlet end 52 of the conduit 50. Alternatively, the speed of the barriers 10 can be constant and the level of the flow at the inlet end 52 used to control the speed of the feed pump 60. In either case, the flow level is to be maintained relatively constant. If the flow level rises too high, the flow may enter the continuation section 56 and if the level falls too low, gases may enter the flow. Similarly, the flow level at the outlet end 54 of the conduit 50 is controlled by adjusting the speed of the backpressure pump 64. If that level rises too high, the flow may be carried to the continuation section 56 and if the level falls too low, gases may enter the flow. In any case, the proper level of the flow at the inlet and outlet ends 52, 54 needs to be maintained for proper operation.

Examples of the gas for the pressurization of the system can be steam, air or nitrogen. The gas is used to achieve the desired pressures and prevent the flow from entering the continuation section 56. Higher pressures allow higher process temperatures to process the food, while preventing the boiling of the liquid in the flow. Steam is one preferred gas with which to pressurize the continuation section 56 for food processing. The use of high pressure steam maintains the sterility of the continuation section 56. The steam effectively serves as a barrier between unprocessed and processed food. Steam or other sterilants can also be used to sterilize the entire device before processing begins. The system is relatively easy to clean. As for example, brushes (not shown) can be temporarily added between one or more sets of barriers 10 to assist in cleaning the conduit 50. Also, spray nozzles (not shown) in the continuation section 56 can be used to automatically clean the barriers 10 as they move through the continuation section 56.

Figure 6:
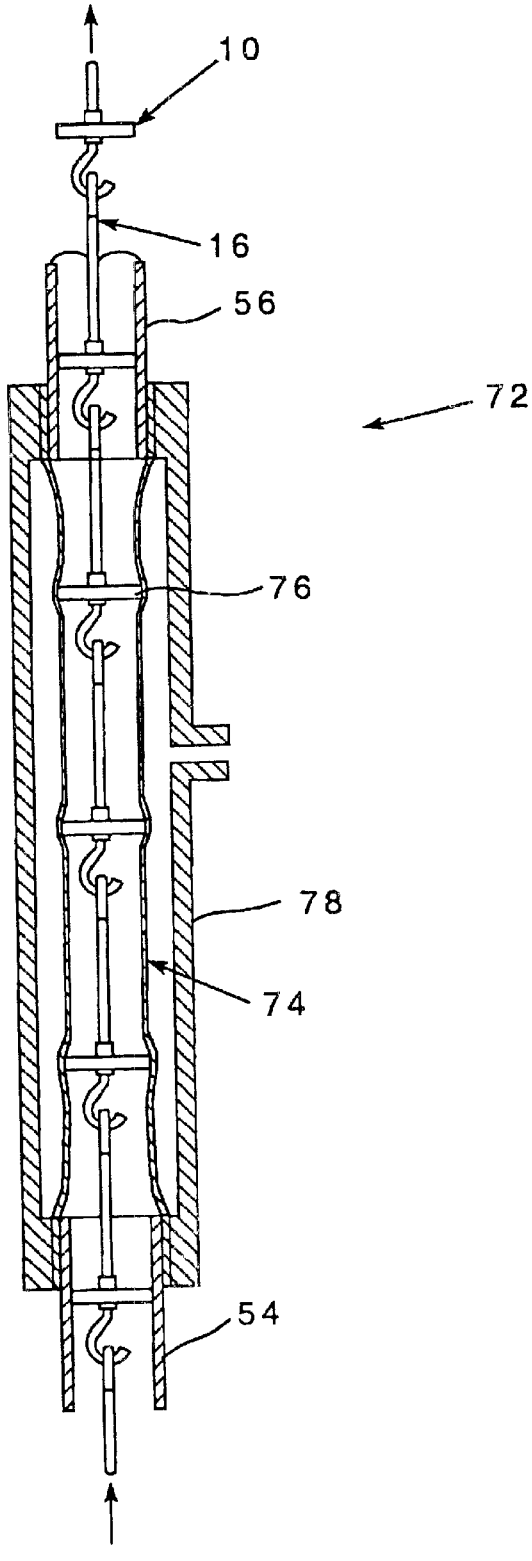
FIG. 6 is a cross-sectional view of a seal unit according to the present invention.

FIG. 6 shows one configuration for the seal unit 72. Between the outlet end 54 of the conduit 50 and the continuation section 56 is a flexible conduit 74 made of a flexible material, such as rubber. The flexible conduit 74 is sized such that it seals along the outside 76 of the barriers 10 as they move through the seal unit 72 and expand the flexible material. By adding the shown optional jacket 78 and pressurizing between the jacket 78 and the flexible conduit 74, seal effectiveness can be increased.

Aseptic food processing systems normally contain a heat exchanger to heat, followed by a holding tube, which is followed by a heat exchanger to cool. The segmented flow device can be used in any part or all of these process steps. By heating or cooling the segmented flow device with a heating or cooling mechanism, the device serves as a heat exchanger. Independent segmented flow devices can be used for each process step, or one device can serve all of the functions. For example, a first section length of the device could be heated with a steam jacket, a center section length could serve as a holding tube, and a third section length could be cooled with a glycol jacket. Thus, heating, holding and cooling are all performed by the same unit and residence time of trapped particles is controlled throughout all these three primary steps of aseptic food processing.

Although the example presented deals with the aseptic processing of liquid based foods with solid particles, the invention is applicable to virtually any process where it is important to achieve a nearly constant residence time of solid particles and/or liquid particles of a flow. Such applications include heat exchange, holding for thermal processing, and reactions (chemical, catalytic, enzymatic, biological, etc.). In the case of heat transfer applications the barriers can additionally serve to enhance heat transfer. Barriers 10 that wipe the interior surface of a conduit or containment vessel allow the device to serve as a scraped surface heat exchanger. Heat transfer can be further enhanced by cycling the barriers 10 forward and backward. The total amount of forward movement should be greater than the amount of backward movement to achieve the net forward movement required to provide the desired residence time. As an example, a cycle movement might be forward 0.5 X and backward 0.4 X, where X is the distance between the barriers 10.

While embodiments of the invention has been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A segmented flow device comprising:

a processing conduit having an inlet and an outlet end;

a feed port adapted for receiving a liquid based material to be processed near said inlet end;

a release port for removing said liquid based material after processing near said outlet end;

a series of barriers moving through said processing conduit to segment said liquid based material during processing;

a means for providing pressure at said inlet end and a means for providing pressure at said outlet end, said barriers further providing a bypass means for allowing part of said liquid based material to move between said barriers; and a conduit continuation section providing an enclosed path between said inlet and outlet ends of said processing conduit for receiving said barriers from said outlet end and returning said barriers to said inlet end.

2. The device of claim 1, wherein said bypass means further comprise perforations in said barriers to allow part of said liquid based material to flow past said barriers.

3. The device of claim 1, wherein said bypass means further comprise a gap between an outside edge of said barriers and an inside wall of said processing conduit to allow part of said liquid based material to flow past said barriers.

4. The device of claim 1, further including a seal unit between said inlet and outlet ends for maintaining a separation between said inlet and outlet pressures.

5. The device of claim 4, wherein said seal unit includes a flexible conduit to provide a tight seal between an outside edge of said barriers and an inside wall of said flexible conduit, as said barriers pass through said flexible conduit on a path from said outlet end to said inlet end.

6. The device of claim 5, further including a sealed jacket about said flexible conduit to provide pressure between said jacket and said flexible conduit.

7. The device of claim 1, wherein said processing conduit includes a heating mechanism to heat said liquid based material.

8. The device of claim 1, wherein said processing conduit includes a cooling mechanism to cool said liquid based material.

9. The device of claim 1, wherein said processing conduit is divided into a first, second and third section; wherein said first section includes a heating mechanism to heat said liquid based material in said first section; and wherein said third section including a cooling mechanism to cool said liquid based material in said third section.

10. The device of claim 1, wherein said processing conduit is divided into a first, second and third section; wherein said first section includes a heating mechanism to heat said liquid based material in said first section; and wherein said third section includes a cooling mechanism to cool said liquid based material in said third section.

11. The device of claim 1, wherein a continuation section includes a drive unit for propelling said barriers through said processing conduit.

12. The device of claim 11, wherein said barriers are linked together by links and wherein said drive unit includes a sprocket to engage said links.

13. The device of claim 1, wherein said inlet end and said outlet end include a sensor for monitoring the flow and sending data to electronics which control flow speed and pressure in said processing conduit.

14. The device of claim 1, further including a feed pump for inserting the liquid based material into said feed port.

15. The device of claim 1, further including a backpressure pump to remove the liquid based material from said release port.

16. A segmented flow device comprising:

a processing conduit having an inlet end and an outlet end;

a feed port for inserting a liquid based material to be processed;

a release port for removing said liquid based material after processing;

a series of barniers moving through said processing conduit to segment said liquid based material during processing, said barriers providing a bypass means for allowing part of said liquid based material to move between said barriers;

a conduit continuation section providing a path between said inlet and outlet ends of said processing conduit for receiving said barriers from said outlet end and returning said barriers to said inlet end;

a first input for providing an inlet pressure to said inlet end and a second input for providing an outlet pressure at said outlet end, such that said inlet and outlet pressures are for controlling said liquid based material; and a seal unit between said inlet and outlet ends for maintaining a separation between said inlet and outlet pressures.

17. The device of claim 16, wherein said bypass means further comprise perforations in said barriers to allow part of said liquid based material to flow past said barriers.

18. The device of claim 17, wherein said processing conduit is divided into a first, second and third section; wherein said first section includes a heating mechanism to heat said liquid based material in said first section; and wherein said third section includes a cooling mechanism to cool said liquid based material in said third section.

19. The device of claim 17, further including a feed pump for inserting said liquid based material into said feed port; further including a backpressure pump to remove said liquid based material from said release port.

20. The device of claim 19, wherein said inlet end and said outlet end each include a sensor for monitoring said liquid based material and sending data to electronics which control said drive unit, said feed pump, said backpressure pump and input of said pressure into said processing conduit.

21. A method of processing a flow comprising:

inputting a liquid based material into a processing conduit having an inlet end and an outlet end;

segmenting said liquid based material in said processing conduit using a series of barriers moving through said processing conduit;

providing a pressure at said inlet end and a pressure at said outlet end;

providing a bypass means for allowing part of said liquid based material to move between said barriers; and controlling said part of said liquid based material moving between said barriers by differentiating the pressures at said inlet and outlet ends.

22. The method of claim 21, wherein heat is provided to said processing conduit to heat said liquid based material.

23. The method of claim 21, wherein cooling is provided to said processing conduit to cool said liquid based material.

24. The method of claim 21, wherein said processing conduit includes a first section, second section and third section; wherein heat is provided to said first section of said processing conduit to heat said liquid based material and wherein cooling is provided to said third section to cool said liquid based material.

25. The method of claim 21, wherein said bypass means is perforations in said barriers.

* * * * *

UNITED STATES PATENT AND TRADEMARK OFFICE

CERTIFICATE OF CORRECTION

PATENT NO. : 6,457,513 B1
APPLICATION NO. : 09/601661
DATED : October 1, 2002
INVENTOR(S) : Walker It is certified that error appears in the above-identified patent and that said Letters Patent is hereby corrected as shown below:

Face of the Patent, immediately after the title, kindly insert the following:

-- STATEMENT REGARDING FEDERALLY SPONSORED RESEARCH
This invention was made with the support of the United States Government Under U.S.D.A. Hatch Act Project No. PEN03419. --

Signed and Sealed this

Twenty-ninth Day of January, 2008

Jon W. Dudas

JON W. DUDAS
*Director of the United States Patent and Trademark Office*

UNITED STATES PATENT AND TRADEMARK OFFICE

CERTIFICATE OF CORRECTION

PATENT NO. : 6,457,513 B1
APPLICATION NO. : 09/601661
DATED : October 1, 2002
INVENTOR(S) : Walker It is certified that error appears in the above-identified patent and that said Letters Patent is hereby corrected as shown below:

Face of the Patent, Col. 1 Lines 1-4 immediately after the title, kindly insert the following:

-- STATEMENT REGARDING FEDERALLY SPONSORED RESEARCH
This invention was made with government support
under Hatch Act Project No. PEN03419 awarded by the USDA.
The Government has certain rights in the invention. --

Signed and Sealed this

Twelfth Day of August, 2008

JON W. DUDAS
*Director of the United States Patent and Trademark Office*